US005891269A

United States Patent [19]

Koerner et al.

[11] Patent Number: 5,891,269

[45] Date of Patent: Apr. 6, 1999

[54] METHOD OF COMPACTING ANODIZED METALS WITH LITHIUM AND FLUORIDE-CONTAINING SOLUTIONS WITHOUT USING HEAVY METALS

[75] Inventors: Torsten Koerner, Duesseldorf; Josef Kresse, Rommerskirchen; Juergen Lindener, Duesseldorf; Wolf-Achim Roland, Solingen, all of Germany

[73] Assignee: Henkel Kommanditgesellschaft auf Aktien, Duesseldorf, Germany

[21] Appl. No.: 983,130

[22] PCT Filed: Jun. 29, 1996

[86] PCT No.: PCT/EP96/02848

§ 371 Date: Jan. 7, 1998

§ 102(e) Date: Jan. 7, 1998

[87] PCT Pub. No.: WO97/03232

PCT Pub. Date: Jan. 30, 1997

[30] Foreign Application Priority Data

Jul. 7, 1995 [DE] Germany ..... 195 24 828.7

[51] Int. Cl.[6] ..... C25D 11/18

[52] U.S. Cl. ..... 148/272; 148/276; 205/199; 205/200; 205/203; 205/204

[58] Field of Search ..... 148/272, 276; 205/199, 200, 202, 203, 204

[56] References Cited

U.S. PATENT DOCUMENTS

| | | | |
|---|---|---|---|
| 4,121,980 | 10/1978 | Gohausen et al. | 204/35 N |
| 4,225,398 | 9/1980 | Hasegawa et al. | 204/33 |
| 4,939,001 | 7/1990 | Brodalla et al. | 427/419.2 |
| 5,411,607 | 5/1995 | Basaly et al. | 148/272 |

FOREIGN PATENT DOCUMENTS

| | | |
|---|---|---|
| 0 171 799 | 2/1986 | European Pat. Off. . |
| 2385819 | 10/1978 | France . |
| 26 50 989 | 5/1978 | Germany . |
| 38 20 650 | 12/1989 | Germany . |

OTHER PUBLICATIONS

Ullmann's Encyclopedia of Industrial Chemistry, 5th Ed., vol. A9 pp. 174–176 (1987).

Angew. Chem. Adv. Mater. 101(7):975–77 (1989).

The Surface Treatment and Finishing of Aluminum and its Alloys, vol. 2, 5th Ed., Chap.11, ASM International and Finishing Publications LTD pp. 773–856 (1987).

*Primary Examiner*—Kathryn Gorgos
*Assistant Examiner*—William T. Leader
*Attorney, Agent, or Firm*—Ernest G. Szoke; Wayne C. Jaeschke; Norvell E. Wisdom, Jr.

[57] ABSTRACT

A process for sealing anodized metals without using any heavy metals comprises a first step in which the anodized metal is contacted for a period of between 3 and 30 minutes (for an anodized layer thickness of 20 $\mu$m) with an aqueous solution which has a temperature from 15° to 35° C. and a pH between 5.0 and 6.5 and contains from 0.1 to 3 g/l of lithium ions and from 0.1 to 5 g/l of fluoride ions and a second step in which the anodized metal is contacted for a period from 5 to 30 minutes (for an anodized layer thickness of 20 $\mu$m) with water or an aqueous solution of substances which prevent the formation of a sealing coating, the solution having a pH from 5.5 to 8.5 and a temperature from 80° to 100° C.

20 Claims, No Drawings

METHOD OF COMPACTING ANODIZED METALS WITH LITHIUM AND FLUORIDE-CONTAINING SOLUTIONS WITHOUT USING HEAVY METALS

This is a national stage application of PCT/EP96/02848, filed Jun. 29, 1996.

FIELD OF THE INVENTION

This invention relates generally to the production of corrosion-controlling and/or decorative coatings on metals by anodic oxidation. More particularly, the invention relates to a new process for sealing the electrochemically produced porous anodizing layers for further improving their properties.

TECHNICAL BACKGROUND AND RELATED ART

The electrochemical anodic oxidation of metals in suitable electrolytes is a widely used process for forming corrosion-controlling and/or decorative coatings on suitable metals. These processes are briefly characterized, for example, in *Ullmann's Encyclopedia of Industrial Chemistry*, 5th Edition, Vol. 9 (1987), pages 174 to 176. According to this literature reference, titanium, magnesium and aluminium and their alloys can be anodized, the anodization of aluminium and its alloys having the greatest industrial significance. The electrolytically produced anodizing layers protect the aluminium surfaces against the effects of weathering and other corrosive media. Anodizing layers are also applied to obtain a harder surface and hence to increase the resistance of the aluminium to wear. Particular decorative effects can be obtained through the color of the anodizing layers and through absorptive or electrolytic coloring. The anodization of aluminium takes place in an acidic electrolyte, sulfuric acid being the most widely used. Other suitable electrolytes are phosphoric acid, oxalic acid and chromic acid. The properties of the anodizing layers can be varied within wide limits through the choice of the electrolyte and its temperature and through the current density and anodizing time. The anodizing process is normally carried out with direct current or with direct current superimposed on alternating current.

The fresh anodizing layers may subsequently be colored by immersion in solutions of a suitable dye or by an alternating-current treatment in an electrolyte containing a metal salt and preferably in a tin-containing electrolyte. As an alternative to subsequent coloring, colored anodizing layers can be obtained by so-called color anodizing processes which are carried out, for example, in solutions of organic acids, more particularly sulfophthalic acid or sulfanilic acid, optionally in admixture with sulfuric acid.

These anodically produced protective layers, of which the structure has been scientifically investigated (R. Kniep, P. Lamparter and S. Streeb: "Structure of Anodic Oxide Coatings on Aluminium", *Angew. Chem, Adv. Mater* 101 (7), pages 975 to 977 (1989)), are frequently referred to as "oxide coatings". However, the study mentioned above revealed that these coatings are glass-like and contain tetrahedrally coordinated aluminium. No octahedrally coordinated aluminium, as present in the aluminium oxides, was found. Accordingly, the more general term "anodizing layers" is used in this patent application instead of the misleading term "oxide coatings".

However, these layers are still not entirely satisfactory in regard to corrosion control because they still have a porous structure. For this reason, the anodizing layers have to be sealed. The sealing process is often carried out with hot or boiling water or, alternatively, with steam. Sealing closes the pores and hence considerably increases protection against corrosion. Extensive literature is available on the sealing process, cf. for example S. Wemick, R. Pinner and P. G. Sheasby: *The Surface Treatment and Finishing of Aluminium and its Alloys* (Vol. 2, 5th Edition, Chapter 11: "Sealing Anodic Oxide Coatings", (ASM International, Metals Park, Ohio, USA and Finishing Publications LTD, Teddington, Middlesex, England, 1987).

In the sealing of anodizing layers, however, not only are the pores closed, a more or less thick velvet-like coating, the so-called sealing film, is formed over the entire surface. This film, which consists of hydrated aluminium oxide, is visually unattractive, reduces bond strength in the bonding of correspondingly treated aluminium parts and promotes subsequent soiling and corrosion. Since the subsequent removal of this sealing film by hand either mechanically or chemically is laborious, attempts have been made to prevent the formation of this sealing film by addition of chemicals to the sealing bath. According to DE-C-26 50 989, additions of cyclic polycarboxylic acids containing 4 to 6 carboxyl groups in the molecule, more particularly cyclohexane hexacarboxylic acid, are suitable for this purpose. According to DE-A-38 20 650, certain phosphonic acids, for example 1-phosphonopropane-1,2,3-tricarboxylic acid, may also be used.

In cases where water containing no additives other than the sealing film inhibitors mentioned is used, high temperatures (at least 90° C.) and relatively long treatment times, of the order of 1 hour for an anodizing layer thickness of about 20 $\mu$m, are required for effective sealing. Accordingly, the sealing process is energy-intensive and, on account of its duration, can slow down the rate of production. Accordingly, a search has already been started for sealing bath additives which support the sealing process so that it can be carried out at lower temperatures (so-called cold sealing) and/or over shorter treatment times. The following additives, for example, have been proposed for sealing at temperatures below 90° C.: nickel salts, more particularly fluorides, of which some are already being used in practice (EP 171 799); nitrosyl pentacyanoferrate; complex fluorides of titanium and zirconium; and chromates or chromic acid, optionally in conjunction with other additives. As an alternative to actual sealing, hydrophobicization of the oxide coating with long-chain carboxylic acids or waxes has been recommended, as has treatment with acrylamides which are said to be polymerized within the pores. Further information on this subject can be found in the above-cited literature reference of S. Wernick et al. With the exception of sealing with nickel compounds, none of these proposals has ever been successfully adopted in practice.

Cold sealing processes using nickel fluoride have been introduced on an industrial scale. On account of the toxic properties of nickel salts, however, elaborate measures have to be taken to treat the wastewater.

Accordingly, there is still a need for alternative sealing processes for anodized surfaces which would enable the production rate to be increased and/or energy consumption to be reduced through shorter sealing times, without any need to use ecologically and physiologically unsafe heavy metals, such as nickel for example. The problem addressed by the present invention was to provide such a process.

BRIEF SUMMARY OF THE INVENTION

The present invention relates to a process for sealing anodized metals without using heavy metals, characterized in that the anodized metal:

a) in a first step, is contacted for 0.15 to 1.5 minutes per micrometre of anodizing layer thickness with an aqueous solution which has a temperature of 15° to 35° C. and a pH value of 5.0 to 6.5 and which contains 0.1 to 3 g/l of lithium ions and 0.1 to 5 g/l of fluoride ions; and b) in a second step, is contacted for 0.25 to 1.5 minutes per micrometre of anodizing layer thickness either with water or with an aqueous solution of sealing film inhibitors which has a pH value of 5.5 to 8.5 and a temperature of 80° to 100° C.

DETAILED DESCRIPTION OF THE INVENTION

The treatment solutions may be contacted with the anodized metals by spraying the solutions onto the metal surfaces or, preferably, by immersing the metal parts in the solutions. For the standard anodizing layer thickness of about 20 $\mu$m, the necessary treatment times are 3 to 30 minutes for step a) and 5 to 30 minutes for step b).

Rinsing with water is preferably carried out between steps a) and b), again by spraying or immersion. Mains water or process water may be used for rinsing, although deionized water is preferred. The rinsing step is preferably carried out for 2 to 30 seconds.

The lithium ions required for step a) may be introduced, for example, in the form of lithium hydroxide, in which case the pH of the treatment solution must be adjusted with an acid to a value in the range according to the invention, i.e. to a value of about 5.0 to about 6.5. Suitable acids are, for example, nitric acid, sulfuric acid and water-soluble carboxylic acids, such as formic acid or acetic acid for example, hydroxycarboxylic acids, for example lactic acid, or amino acids, for example glycine. However, the lithium ions are preferably introduced directly in the form of water-soluble salts. "Water-soluble" salts in this context are salts which are sufficiently soluble to provide a lithium ion concentration in the range according to the invention. Examples of such salts are lithium halides, more particularly lithium fluoride, lithium chlorate, lithium perchlorate, lithium nitrate, lithium sulfate and lithium salts of carboxylic acids containing no more than 6 carbon atoms, the carboxylic acids being monobasic or polybasic and bearing such substituents as, for example, hydroxyl or amino groups. Examples of such lithium carboxylates are lithium formate, lithium acetate, lithium lactate and lithium glycinate. Lithium acetate is particularly preferred. The lithium compounds are preferably used in such a quantity that the lithium ions concentration is between about 0.25 and about 1.5 g/l.

The fluoride ions used in step a) may be introduced in free form or in complexed form. In both cases, the corresponding acids, such as hydrofluoric acid for example, are suitable in principle as the source of fluoride ions, the pH of the bath having to be raised by the addition of alkalis to a value in the range according to the invention. Suitable alkalis are, for example, lithium hydroxide, sodium hydroxide, potassium hydroxide or ammonia. However, the fluoride ions are preferably used in the form of water-soluble salts, "water-soluble" in this context again signifying that the salts are sufficiently soluble to provide the concentration of free or complexed fluoride ions according to the invention. Examples of salts which yield free fluoride ions are lithium fluoride, sodium fluoride, potassium fluoride or acidic variants thereof, for example $KHF_2$, the pH of the treatment solution optionally having to be adjusted by addition of alkalis. Sodium fluoride is particularly preferred as the source of free fluoride ions. Alternatively, the fluorides ions may be used in complexed form, for example in the form of tetrafluoroborate, hexafluorosilicate, hexafluorotitanate or hexafluorozirconate, which are preferably used as ammonium or alkali metal salts, more particularly sodium salts. Hexafluorosilicate is particularly preferred as the complex fluoride and may be used, for example, in the form of the sodium salt. The calculated concentration of the free or complexed fluoride ions is preferably in the range from about 0.25 to about 2 g/l.

If the treatment time in step a) is any less than 0.15 minute per micrometer of anodizing layer thickness, the sealing effect according to the invention occurs to only a very limited extent, if at all. Although treatment times of longer than 1.5 minutes per micrometre of anodizing layer thickness are not harmful, they do not afford any additional advantages and, accordingly, are uneconomical. The treatment time in step a) is preferably between 0.25 and 0.75 minute per micrometer of anodizing layer thickness. The pH value is preferably in the range from about 5.5 to 6.0.

The sealing effect and the resulting prevention of corrosion can be further improved if the solution used in step a) additionally contains one or more of the following components:

1. 10 to 2,000 ppm of alkali metal or ammonium salts of saturated or unsaturated monocarboxylic acids containing 8 to 22 carbon atoms;
2. 0.01 to 1,000 ppm of anionic, cationic or nonionic surfactants, preferably nonionic surfactants and, more preferably, ethoxylation products of fatty amines, for example of cocosamine;
3. 10 to 2,000 ppm of molybdates, tungstates or vanadates in monomeric or oligomeric form, either individually or in admixture with one another;
4. 1 to 1,000 ppm, and preferably 10 to 100 ppm of homopolymers or copolymers, of acrylic and/or methacrylic acid and/or maleic acid, which may additionally contain phosphonic acid groups and which have an average molecular weight of 200 to 2,000 and preferably from 400 to 800.

Where additives such as those listed above are used, it is important to ensure that the pH of the treatment solution remains in the range crucial to the invention. Where additives in acidic form are used, the pH of the treatment solution may optionally have to be readjusted, preferably using ammonia or alkali metal hydroxide solutions.

According to the invention, the treatment solution used in step a) has a temperature of about 15° to about 35° C. Good results are reliably obtained if the temperature of the treatment solution is adjusted to a value of 18° to 25° C.

Step a) of the process according to the invention may be regarded as a preliminary sealing step because, although the properties of the layer are improved in relation to an unsealed anodizing layer, the technical standards that the properties of the anodizing layers are expected to meet, as discussed in the following, are generally still not achieved. Accordingly, this preliminary sealing step is followed—preferably after rinsing with water, more particularly deionized water—by final sealing as step b), carried out by immersion in a conventional hot sealing bath with a temperature of 80 to 100° C. Hot sealing baths of the type used at present are suitable for this purpose. For example, the commercial hot sealing bath P3-almecoseal-SL® (Henkel KGaA, Duisseldort) may be used. It is operated at a temperature of 96° C. or higher and at a pH value of 5.8 to 8.2 (Speedseal). The necessary final sealing time in a hot sealing bath of this type is between 0.25 and 1.5 minutes, and preferably between 0.75 and 1.25 minutes, per micrometre of anodizing layer thickness, times of longer than 1 minute per micrometer of anodizing layer thickness generally being unnecessary. In the same way as for conventional hot sealing, the treatment solution for step b) may have a temperature of 90° to 98° C. and, more particularly, a temperature of about 96° C.

The conventional hot sealing baths preferably used in step b) contain sealing-film-inhibiting additives. Examples of such additives are the cyclic polycarboxylic acids containing 4 to 6 carboxyl groups in the molecule mentioned in the above-cited DE-C-26 50 989, cyclohexane hexacarboxylic acid being particularly suitable. The phosphonic acids mentioned in DE-A-38 20 650, for example 1-phosphonopropane-1,2,3-tricarboxylic acid or 1,1-diphosphonopropane-2,3-dicarboxylic acid, may be used instead of or in admixture with such cyclic polycarboxylic acids. These additives may be used in concentrations of 0.0005 to 0.2 g/l, phosphonic acids preferably being used in concentrations of 0.003 to 0.1 g/l.

Accordingly, the process according to the invention is preferably used for preliminary sealing in conjunction with conventional hot sealing. Although this involves an additional treatment step in relation to the prior art, it does have the advantage that the overall treatment time is shortened despite the additional step, so that productivity per unit of time is increased. In addition, the shorter batch times and, optionally, lower temperatures in the following hot sealing bath reduce the consumption of energy per batch, which is mainly attributable to the evaporation losses during the treatment. Accordingly, the process according to the invention is more economical for continuous operation than conventional hot sealing, where the treatment time per batch in the hot sealing bath is about 1 hour. By contrast, the total sealing time after anodization is reduced by about half in the process according to the invention. Compared with conventional nickel-based cold sealing processes, the process according to the invention is distinguished by better environmental compatibility.

The accelerated energy-saving process according to the invention gives sealed anodizing layers which are in no way inferior in their properties to conventionally produced anodizing layers. Important test parameters for layer quality include, in particular, erosion in chromic acid, admittance and the color drip test. These quality criteria are determined by standard tests which are described in the Examples.

The sealing process according to the invention is preferably used for anodized aluminium and anodized aluminium alloys. However, it may also be applied to the anodizing layers of other anodizable metals such as, for example, titanium and magnesium or their alloys. It can be used both for uncolored anodizing layers and for anodizing layers which have been colored by conventional processes, for example integral coloring, adsorptive coloring using organic dyes, reactive coloring where inorganic pigments are formed, electrochemical coloring using metal salts, more particularly tin salts, or interference coloring. In the case of adsorptively colored anodizing layers, the process according to the invention has the further advantage that the possible bleeding of the dye in conventional hot sealing is reduced by the shortened sealing time and by the low temperature in the first sealing step.

EXAMPLES

Aluminium sheets of the Al 99.5 type were conventionally anodized (direct current/sulfuric acid, one hour, layer thickness 20 $\mu$m) and optionally colored either electrochemically or with organic immersion dyes. The sheets were then immersed for 10 minutes at 20° C. in the sealing solutions according to the invention and the comparison solutions a) as identified in the following Table. Unless otherwise stated, the pH value was adjusted with ammonia or acetic acid. This was followed by rinsing for 2 to 10 seconds with deionized water. The sheets thus presealed were then finally sealed for 20 minutes in a conventional, commercially available hot sealing bath containing cyclohexane hexacarboxylic acid (2 g/l, P3-almecoseal® SL, Henkel KGaA, Dusseldorf) at 96° C. and at pH 6.0 (step b)). Further particulars can be found in the Table.

To monitor the quality of sealing, standard layer quality tests were carried out immediately after final sealing:

The admittance value $Y_{20}$ was determined in accordance with DIN 50949 using a Fischer Anotest Y D 8.1 measuring system. This measuring system consists of two electrodes of which one is conductively connected to the base material of the sample. The second electrode is immersed in an electrolyte cell which can be placed on the layer to be tested. This cell is in the form of a rubber ring, with an internal diameter of 13 mm and a thickness of about 5 mm, the surface of which is self-adhesive. The test area measures 1.33 $cm^2$. The electrolyte used is a potassium sulfate solution (35 g/l) in deionized water. The admittance value indicated by the measuring instrument is based on a temperature of 25° C. and a layer thickness of 20 $\mu$m in accordance with DIN 50949. The values obtained, which should preferably be between 10 and about 20 $\mu$S, are shown in the Table.

The residual reflection after coloring with dye in accordance with DIN 50946 was measured as the parameter that indicates open-pore and hence poorly sealed layers. The test surface is defined by the self-adhesive measuring cell of the Anotest instrument described above. The test surface is wetted with an acid solution (25 ml/l sulfuric acid, 10 g/l KF). After exactly one minute, the acid solution is washed off and the test surface is dried. The test surface is then wetted with dye solution (5 g/l Sanodalblau) which is allowed to act for 1 minute. After rinsing under running water, the measuring cell is removed. The colored test surface is freed from loosely adhering dye by rubbing with a mild powder cleaner. After drying, the surface is subjected to a relative reflex measurement by placing the measuring head of a light reflection instrument (Dr. Lange Micro Color) once on an uncolored part of the surface and once on the colored part. The residual reflection in percent is obtained by dividing the quotient of the reflection of the colored surface by the reflection of the uncolored surface and multiplying by 100. Residual reflection values of 95 to 100% signify high quality of sealing while values below 95% are unacceptable. The quality of sealing is higher, the higher the residual reflection values. The results obtained are set out in the Table.

In addition, acid erosion was measured in accordance with ISO 3210. To this end, the test sheet is weighed out to exactly 0.1 mg and is then immersed for 15 minutes at 38° C. in an acid solution containing, per liter, 35 ml of 85% phosphoric acid and 20 g of chromium(VI) oxide. After the test, the sample is rinsed with deionized water and dried in a drying cabinet for 15 minutes at 60° C. The sample is then reweighed. The difference in weight between the first and second measurements is calculated and is divided by the size of the surface in $dm^2$. The weight loss is expressed in $mg/dm^2$ and should not exceed 30 $mg/dm^2$.

TABLE

SEALING PARAMETERS AND LAYER QUALITY

| Example No. | Solution a): $Li^+$, mg/l | $F^-$, mg/l | pH | Admittance Value, $\mu S$ | % Residual Reflection | Acid Erosion, $mg/dm^2$ |
|---|---|---|---|---|---|---|
| Example 1 | 343[a)] | 540[b)] | 5.5 | 12 | 96 | 20.4 |
| Example 2 | 549[c)] | 540[b)] | 5.5 | 10 | 100 | 13.6 |
| Example 3 | 686[d)] | 540[b)] | 5.5 | 11 | 99 | 19.9 |
| Example 4 | 360[e)] | 540[b)] | 5.5 | 12 | 95 | 18.2 |
| Example 5 | 580[f)] | 540[b)] | 5.5 | 13 | 96 | 20.1 |
| Example 6 | 720[g)] | 540[b)] | 5.5 | 16 | 97 | 25.4 |
| Example 7 | 640[h)] | 540[b)] | 6 | 9 | 99.5 | 10.2 |
| Example 8 | 1020[i)] | 540[b)] | 6 | 10 | 99 | 8.7 |
| Example 9 | 1270[k)] | 540[b)] | 5.5 | 10 | 99 | 11.3 |
| Example 10 | 343[a)] | 1200[l)] | 5.5 | 14 | 98 | 25.4 |
| Example 11 | 549[c)] | 1200[l)] | 5.5 | 11 | 98 | 18.2 |
| Example 12 | 686[d)] | 1200[l)] | 5.5 | 10 | 96 | 28.3 |
| Comp. 1 | 343[a)] | — | 5.5 | 42 | 91 | 33 |
| Comp. 2 | 549[c)] | — | 5.5 | 38 | 92 | 31 |
| Comp. 3 | — | 540[b)] | 5.5 | 33 | 87 | 74 |
| Comp. 4 | — | 994[m)] | 5.5 | White coating, fingerprints | | |
| Comp. 5 | [n)] | 540[b)] | 5.5 | 20 | 93 | 45 |

[a)]5 g/l of Li acetate dihydrate
[b)]1.2 g/l of NaF
[c)]8 g/l of Li acetate dihydrate
[d)]10 g/l of Li acetate dihydrate
[e)]5 g/l of Li lactate
[f)]8 g/l of Li lactate
[g)]10 g/l of Li lactate
[h)]5 g/l of Li sulfate
[i)]8 g/l of Li sulfate
[k)]10 g/l of Li sulfate
[l)]2 g/l of $Na_2SiF_6$
[m)]2.2 g/l of NaF
[n)]Na acetate (5 g/l) instead of a Li salt

The invention claimed is:

1. A process for sealing an anodized metal surface without using heavy metals, wherein the anodized metal surface:

a) in a first step, is contacted for 0.15 to 1.5 minutes per micrometre of anodizing layer thickness with an aqueous solution which has a temperature of 15° to 35° C. and a pH value of 5.0 to 6.5 and which contains from 0.1 to 3 g/l of lithium ions and from 0.1 to 5 g/l of fluoride ions; and b) in a second step, is contacted for 0.25 to 1.5 minutes per micrometre of anodizing layer thickness either with water or with an aqueous solution of sealing film inhibitors which has a pH value of 5.5 to 8.5 and a temperature of 80° to 100° C.

2. A process as claimed in claim 1, wherein the anodized metal is rinsed with water between steps a) and b).

3. A process as claimed in claim 2, wherein the aqueous solution used in step a) contains from 0.25 to 1.5 g/l of lithium ions.

4. A process as claimed in claim 3, wherein the aqueous solution used in step a) contains from 0.25 to 2 g/l of fluoride ions.

5. A process as claimed in claim 4, wherein the anodized metal surface is contacted with the aqueous solution in step a) for a time that is between 0.25 and 0.75 minute per micrometer of anodizing layer thickness.

6. A process as claimed in claim 5, wherein the solution used in step a) additionally contains one or more of the following components:

10 to 2,000 ppm of substances selected from the group consisting of alkali metal and ammonium salts of saturated and unsaturated carboxylic acids containing 8 to 22 carbon atoms;

0.01 to 1,000 ppm of substances selected from the group consisting of anionic, cationic and nonionic surfactants;

10 to 2,000 ppm of substances selected from the group consisting of molybdates, tungstates, vanadates and mixtures thereof; and 1 to 1,000 ppm of substances selected from the group consisting of homopolymers and copolymers of scrylic acid, methacrylic acid and maleic acid which have an average molecular weight of 200 to 2,000.

7. A process as claimed in claim 6, wherein the water or the treatment solution used in step b) has a temperature of 90° to 98° C.

8. A process as claimed in claim 7, wherein the anodized metal surface contacts the water or the treatment solution used in step b) for 0.75 to 1.25 minutes per micrometre of anodizing layer thickness.

9. A process as claimed in claim 8, wherein the water or the treatment solution used in step b) contains from 0.005 to 0/2 g/l of substances selected from the group consisting of cyclic polycarboxylic acids containing 4 to 6 carboxyl groups and phosphonic acids.

10. A process as claimed in claim 4, wherein the water or the treatment solution used in step b) contains from 0.005 to 0.2 g/l of substances selected from the group consisting of cyclic polycarboxylic acids containing 4 to 6 carboxyl groups and phosphonic acids.

11. A process as claimed in claim 1, wherein the aqueous solution used in step a) contains from 0.25 to 1.5 g/l of lithium ions.

12. A process as claimed in claim 1, wherein the aqueous solution used in step a) contains from 0.25 to 2 g/l of fluoride ions.

13. A process as claimed in claim 1, wherein the anodized metal surface is contacted with the aqueous solution in step a) for a time that is between 0.25 and 0.75 minute per micrometer of anodizing layer thickness.

14. A process as claimed in claim 13, wherein the water or the treatment solution used in step b) contains from 0.005 to 0.2 g/l of substances selected from the group consisting of cyclic polycarboxylic acids containing 4 to 6 carboxyl groups and phosphonic acids.

15. A process as claimed in claim 1, wherein the solution used in step a) additionally contains one or more of the following components:

10 to 2,000 ppm of substances selected from the group consisting of alkali metal and ammonium salts of saturated and unsaturated carboxylic acids containing 8 to 22 carbon atoms;

0.01 to 1,000 ppm of substances selected from the group consisting of anionic, cationic and nonionic surfactants;

10 to 2,000 ppm of substances selected from the group consisting of molybdates, tungstates, vanadates and mixtures thereof; and 1 to 1,000 ppm of substances selected from the group consisting of homopolymers and copolymers of acrylic acid, methacrylic acid and maleic acid which have an average molecular weight of 200 to 2,000.

16. A process as claimed in claim 15, wherein the water or the treatment solution used in step b) contains from 0.005 to 0.2 g/l of substances selected from the group consisting of cyclic polycarboxylic acids containing 4 to 6 carboxyl groups and phosphonic acids.

17. A process as claimed in claim 1, wherein the water or the treatment solution used in step b) has a temperature of 90° to 98° C.

18. A process as claimed in claim 1, wherein the anodized metal surface contacts the water or the treatment solution used in step b) for 0.75 to 1.25 minutes per micrometre of anodizing layer thickness.

19. A process as claimed in claim 18, wherein the water or the treatment solution used in step b) contains from 0.005 to 0.2 g/l of substances selected from the group consisting of cyclic polycarboxylic acids containing 4 to 6 carboxyl groups and phosphonic acids.

20. A process as claimed in claim 1, wherein the water or the treatment solution used in step b) contains from 0.005 to 0.2 g/l of substances selected from the group consisting of cyclic polycarboxylic acids containing 4 to 6 carboxyl groups and phosphonic acids.

* * * * *